US009950419B2

(12) United States Patent
Rompel et al.

(10) Patent No.: US 9,950,419 B2
(45) Date of Patent: Apr. 24, 2018

(54) HAMMER DRILL

(71) Applicant: Black & Decker Inc., Newark, DE (US)

(72) Inventors: Markus Rompel, Runkel/Schadeck (DE); Michael Kunz, Dorndorf (DE)

(73) Assignee: Black & Decker Inc., New Britain, CT (US)

( * ) Notice: Subject to any disclaimer, the term of this patent is extended or adjusted under 35 U.S.C. 154(b) by 471 days.

(21) Appl. No.: 14/662,302

(22) Filed: Mar. 19, 2015

(65) Prior Publication Data

US 2015/0266179 A1 Sep. 24, 2015

(30) Foreign Application Priority Data

Mar. 20, 2014 (GB) ..... 1404968.8
Mar. 28, 2014 (GB) ..... 1405612.1

(51) Int. Cl.
*B25F 5/02* (2006.01)
*B25D 17/00* (2006.01)
*B25D 16/00* (2006.01)

(52) U.S. Cl.
CPC ..... *B25F 5/02* (2013.01); *B25D 16/00* (2013.01); *B25D 17/00* (2013.01);
(Continued)

(58) Field of Classification Search
CPC ..... B25F 5/02; B25D 16/00; B25D 17/00; H02K 9/06; F16H 57/02
(Continued)

(56) References Cited

U.S. PATENT DOCUMENTS 3,456,740 A * 7/1969 Bronnert ..... B25D 11/125 173/109
3,718,193 A * 2/1973 Wanner ..... B25D 11/125 173/117

(Continued)

FOREIGN PATENT DOCUMENTS

EP 1674215 A1 6/2006
EP 2075094 A1 7/2009
GB 2085345 A 4/1982

OTHER PUBLICATIONS

Arnaud Rilliard, European Search Report, dated Aug. 24, 2015, The Hague.

(Continued)

*Primary Examiner* — Nathaniel Chukwurah
(74) *Attorney, Agent, or Firm* — Amir R. Rohani

(57) ABSTRACT

A hammer drill comprising: a body; a motor mounted within the body; a transmission housing mounted within the body, a transmission mechanism mounted within the transmission housing which is capable of rotatably driving and/or repetitively striking a cutting tool held by the hammer drill in response to rotation of an output shaft of the motor; wherein the transmission housing comprises a pair of housing portions adapted to engage each other to support the component parts of the transmission mechanism within the transmission housing; wherein the first housing portion is made from metal and the second housing portion is made from a plastic material, each of the components of the transmission mechanism being supported jointly be the first and second housing portions.

14 Claims, 13 Drawing Sheets

(52) U.S. Cl.
CPC .... *B25D 2211/068* (2013.01); *B25D 2222/21* (2013.01); *B25D 2222/24* (2013.01); *B25D 2222/54* (2013.01); *B25D 2250/065* (2013.01); *B25D 2250/121* (2013.01); *B25D 2250/345* (2013.01); *B25D 2250/365* (2013.01)

(58) Field of Classification Search
USPC ..... 173/90, 104, 109, 201, 211
See application file for complete search history.

(56) References Cited

U.S. PATENT DOCUMENTS

| | | | | |
|---|---|---|---|---|
| 4,156,468 | A * | 5/1979 | Stiltz | B25D 11/125 173/117 |
| 4,353,425 | A * | 10/1982 | Simpson | B25D 17/00 173/109 |
| 6,719,067 | B2 * | 4/2004 | Taga | B25F 5/02 173/162.2 |
| 7,080,696 | B2 * | 7/2006 | Soika | B25D 17/00 173/216 |
| 2004/0111933 | A1 | 6/2004 | Yoshimizu et al. | |
| 2006/0156859 | A1 * | 7/2006 | Nemetz | B25D 16/00 74/606 R |

OTHER PUBLICATIONS

Annex to the European Search Report on European Patent Application No. EP 15 15 6050.

* cited by examiner

Prior Art

Prior Art

Prior Art

Prior Art

HAMMER DRILL

CROSS-REFERENCE TO RELATED APPLICATIONS

This application claims priority, under 35 U.S.C. § 119, to UK Patent Application No. 1404968.8 filed Mar. 20, 2014 and UK Patent Application No. 1405612.1 filed Mar. 28, 2014, titled "Hammer Drill."

FIELD OF THE INVENTION

The present invention relates to a hammer drill incorporating a transmission housing.

BACKGROUND OF THE INVENTION

Hammer drills are power tools that can often operate in three modes of operation. The hammer drill will have a tool bit that can be operated in a hammering mode, a rotary mode and a combined hammer and rotary mode. The hammer drill will typically comprises an electric motor and a transmission mechanism by which the rotary output of the electric motor rotationally drives the tool bit and/or repetitively strikes the tool bit to perform the hammer function. Such a transmission mechanism can be mounted within a transmission housing which is in turn mounted within an external housing of the hammer drill. The use of a transmission housing allows the transmission mechanism to be assembled within the transmission housing prior to its insertion into the external housing as a single sub-assembly. The transmission housing may also be moveably mounted within the external housing so that the hammer drill can be vibrationally damped.

BRIEF SUMMARY OF THE INVENTION

EP1674215 discloses a hammer drill which has a transmission mechanism mounted within a transmission housing which is mounted within an external housing. EP1674215 indicates that the transmission housing can be made from metal or plastic. It is widely understood that if metal is used to make the transmission housing, the whole of the transmission housing is constructed using metal clam shells. Similarly, it is widely understood that if plastic is used to make the transmission housing, the whole of the transmission housing is constructed using plastic clam shells. This is to ensure the physical properties of the whole of the transmission housing are consistent to provide a balanced support to the components supported within it.

Accordingly there is provided a hammer drill comprising:

a body;

a motor mounted within the body;

a transmission housing mounted within the body, a transmission mechanism mounted within the transmission housing which is capable of rotatably driving and/or repetitively striking a cutting tool held by the hammer drill in response to rotation of an output shaft of the motor;

wherein the transmission housing comprises a pair of housing portions adapted to engage each other to support the component parts of the transmission mechanism within the transmission housing;

characterised in that a first housing portion is made from metal and the second housing portion is made from a plastic material, each of the components of the transmission mechanism being supported jointly be the first and second housing portions.

It has been assumed by engineers that the clam shells of a transmission housing should be made from the same material to provide consistent properties. However, the inventor has found that, when the transmission housing is used to support components of a transition mechanism, the use of a combination of a metal clam shell with a plastic one, where both clam shells support each of the components of the transmission mechanism, provides unusual benefits. The metal clam shell provides rigidity and therefore provides support. However, it needs to be cast and then machined. In existing designs, where two metal clam shells are used, the manufacturing needs to be precise. Plastic material is more flexible but cheaper. Plastic clam shell can be designed with ribs to provide addition support. By using a single metal clam shell, rigidity and support can still be provided. By connecting it to a plastic clam shell, which can flex, the tolerance during the manufacture of the metal clam shell can be reduced as the plastic clam shell can flex to accommodate a wider range of tolerances. It has been assumed that, by having the components supported in a metal clam shell on one side and a plastic clam shell on the other, the support provided to the components would be unbalanced and therefore not desirable. However, to the surprise of the inventor, this has not been found to be the case.

In an embodiment the first housing portion comprises a recess; wherein a seal is integrally moulded within a groove formed around the recess; wherein the second housing portion comprises a recess; wherein a groove is formed around the recess; and wherein the seal locates within the groove in the second housing portion when the first and second housing portions are engaged with each other.

In an embodiment, a semi-circular groove is formed in the first housing portion; where a semi-circular seal is moulded into the groove; wherein a semi-circular recess is formed in the second housing portion; where a semi-circular seal is moulded into the recess; and wherein the semi-circular seal in the first housing portion aligns with the semi-circular seal in the second housing portion when the first and second housing portions are engaged with each other to form a circular seal within the transmission housing. The use of fully circular seals in a transmission mechanism requires that the seals are incorporated during the assembly of the transmission mechanism which can difficult. By manufacturing a circular seal using two semi-circular seals formed within the housing portions improves the ease of manufacture. The semi-circular seals can be moulded into the clam shells prior to the assembly of the transmission mechanism taking place. This is simple and ensures their location remains fixed during assembly. The transmission mechanism can then be simply assembled in one of the housing portions and then the other located on top of it, sandwiching the transmission mechanism inside of it.

In an embodiment, the semi-circular seal in the first housing portion is integral with the seal around the recess.

The first housing portion further extends to provide a housing portion for a motor housing. This provides a structural support to the motor in relation to the transmission mechanism.

In an embodiment, there is provided a third housing portion made from a plastic material which engages with the first housing portion to form a motor housing. By using a third housing portion made from plastic material, it can be ensure that the motor is surrounded by a non conductive housing.

In an embodiment, a semi-circular groove is formed in an edge of a wall of the first housing portion; wherein a semi-circular seal is moulded into the groove; wherein a groove is formed in an edge of a wall of the third housing portion; where a semi-circular seal is moulded into the groove; wherein the semi-circular seal in the first housing portion aligns with the semi-circular seal in the third housing portion when the first and third housing portions are engaged with each other to form a circular seal within the first and third housing portions. The use of fully circular seals requires that the seals are incorporated during the assembly of the transmission mechanism which can difficult. By manufacturing a circular seal using two semi-circular seals formed within the housing portions improves the ease of manufacture. The semi-circular seals can be moulded into the clam shells prior to the assembly of the transmission mechanism taking place. This is simple and ensures their location remains fixed during assembly. The transmission mechanism can then be simply assembled in one of the housing portions and then the other located on top of it, sandwiching the transmission mechanism inside of it.

In an embodiment, the third housing portion comprises grooves formed in an outer wall of the third housing portion; wherein a seal is integrally moulded into the grooves; wherein, when the first, second and third portions are engaged with each other, the seal engages with an outer surface of the second housing portion to form a seal between the second and third housing portions. The circular seal in the third housing portion can be integral with the seal moulded into the grooves.

The semicircular seal in the first portion can be integral with the seal surrounding the recess.

BRIEF DESCRIPTION OF THE DRAWINGS

An embodiment of the present invention will now be described by way of example only and not in any limitative sense, with reference to the accompanying drawings in which.

DETAILED DESCRIPTION OF THE INVENTION

An example of a known hammer drill will now be described in relation to FIGS. 1 to 6.

Figure 1:
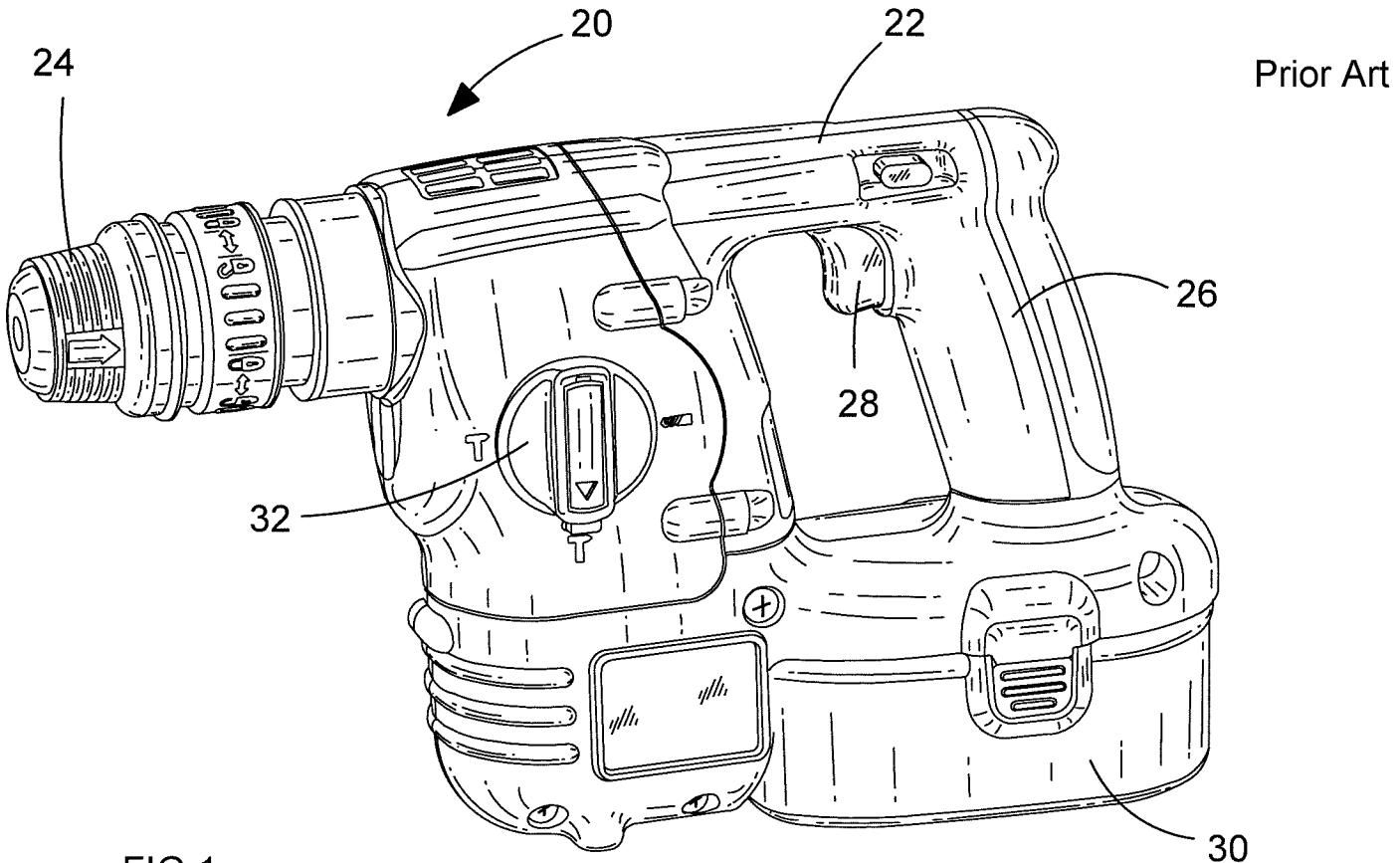
FIG. 1 is a perspective view of an example of a hammer drill.

Referring to FIG. 1, a battery-powered hammer drill comprises a tool housing 22 and a chuck 24 for holding a drill bit (not shown). The tool housing 22 forms a handle 26 having a trigger 28 for activating the hammer drill 20. A battery pack 30 is releasably attached to the bottom of the tool housing 22. A mode selector knob 32 is provided for selecting between a hammer only mode, a rotary only mode and a combined hammer and rotary mode of operation of the drill bit.

Figure 2:
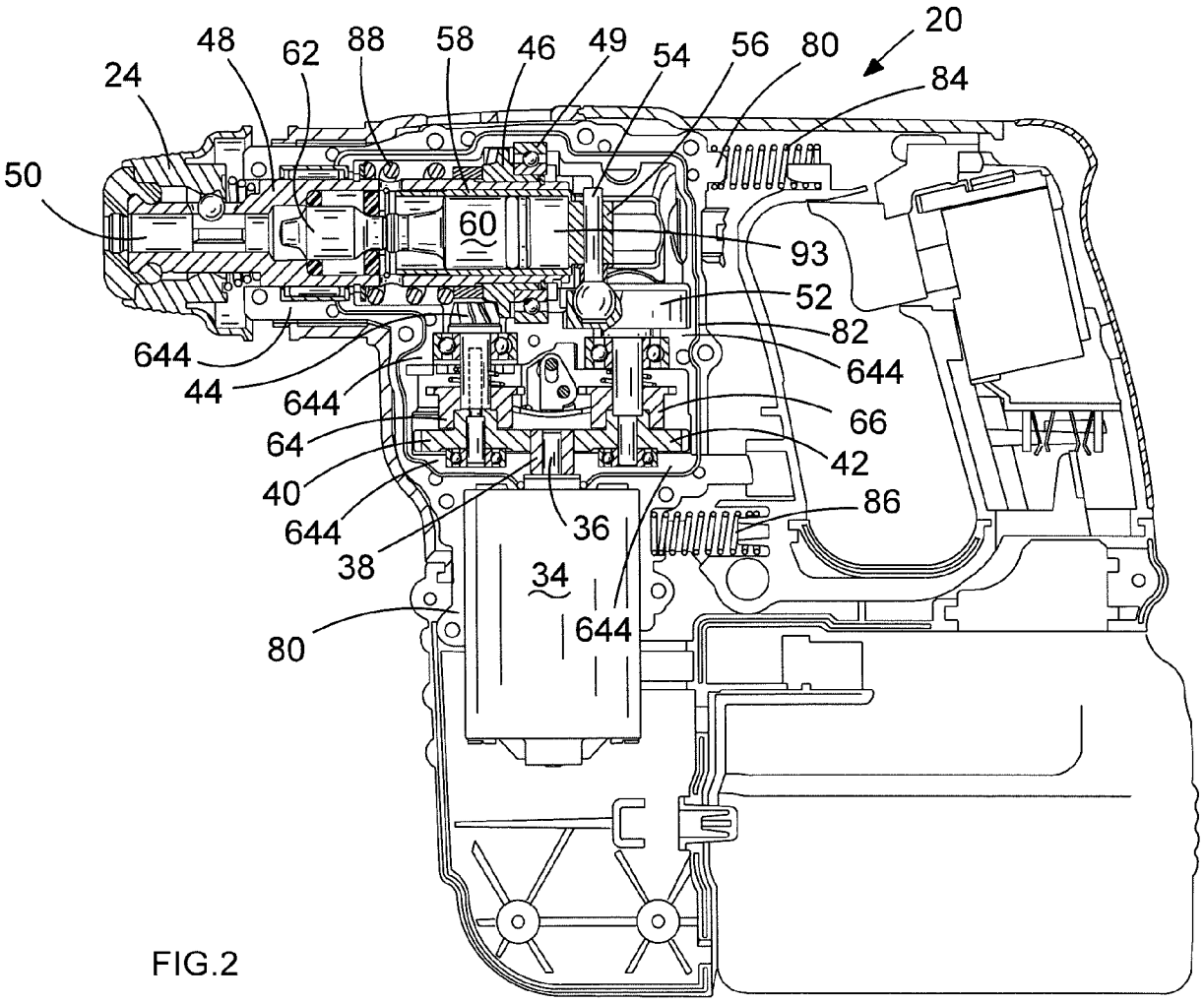
FIG. 2 is a side cross-sectional view of the hammer drill of FIG. 1.

Referring to FIG. 2, an electric motor 34 is provided in the tool housing 22 and has a rotary output shaft 36. A pinion 38 is formed on the end of output shaft 36, the pinion 38 meshing with a first drive gear 40 of a rotary drive mechanism and a second drive gear 42 of a hammer drive mechanism.

An embodiment of the rotary drive mechanism shall be described as follows. A first bevel gear 44 is driven by the first drive gear 40. The first bevel gear 44 meshes with a second bevel gear 46. The second bevel gear 46 is mounted on a spindle 48. Rotation of the second bevel gear 46 is transmitted to the spindle 48 via a clutch mechanism including an overload spring 88. The spindle 48 is mounted for rotation about its longitudinal axis by a spherical ball bearing race 49. A drill bit (not shown) can be inserted into the chuck 24 and connected to the forward end 50 of spindle 48. The spindle 48 and the drill bit rotate when the hammer drill 20 is in a rotary mode or in a combined hammer and rotary mode. The clutch mechanism prevents excessive torques being transmitted from the drill bit and the spindle 48 to the motor 34.

An embodiment of the hammer drive mechanism shall now be described as follows. The pinion 38 of motor output shaft 36 meshes with a second drive gear 42 such that rotation of the second drive gear 42 causes rotation of a crank plate 52. A crank pin 54 is driven by the crank plate 52 and slidably engages a cylindrical bearing 56 disposed on the end of a hollow piston 58. The hollow piston 58 is slidably mounted in the spindle 48 such that rotation of the crank plate 52 causes reciprocation of hollow piston 58 in the spindle 48. A ram 60 is slidably disposed inside hollow piston 58. Reciprocation of the hollow piston 58 causes the ram 60 to reciprocate with the hollow piston 58 as a result of expansion and contraction of an air cushion 93, as will be familiar to persons skilled in the art. Reciprocation of the ram 60 causes the ram 60 to impact a beat piece 62 which in turn transfers impacts to the drill bit (not shown) in the chuck 24 when the hammer drill operating in a hammer mode or a in combined hammer and rotary mode.

A mode change mechanism includes a first and a second drive sleeves 64, 66 which selectively couple the first and second drive gears 40, 42 respectively, to the first bevel gear 44 and the crank plate 52, respectively, in order to allow a user to select between either the hammer only mode, the rotary only mode or the combined hammer and rotary mode. The mode change mechanism is the subject of UK patent application no. 0428215.8.

A transmission mechanism comprises the rotary drive mechanism, the hammer drive mechanism and the mode change mechanism. The transmission mechanism is disposed inside a transmission housing 80. The transmission housing 80 also supports the electric motor 34. The transmission housing is formed from two clamshell halves of durable plastics material or cast metal, the two clamshell halves compressing an o-ring 82 there between. In existing designs, the transmission housing is made from only durable plastics material or of only cast metal. The o-ring 82 seals the transmission housing 80 to prevent dust and dirt from entering the transmission housing and damaging the moving parts of the transmission mechanism.

The transmission housing 80 is slidably mounted inside the tool housing 22 on parallel rails (not shown) and is supported against to the tool housing 22 by first and second damping springs 84 and 86 disposed at its rearward end. The transmission housing 80 can therefore move by a small amount relative to tool housing 22 in order to reduce transmission of vibration to the user during operation of the hammer drill 20. The spring co-efficients of the first and second damping springs 84 and 86 are chosen so that the transmission housing 80 slides to a point generally mid-way between its limits of forward and rearward travel when the hammer drill 20 is used in normal operating conditions. This is a point of equilibrium where the forward bias of the damping springs 84 and 86 equals the rearward force on the transmission housing 80 caused by the user placing the hammer drill 20 against a workpiece and leaning against the tool housing 22.

Figure 3:
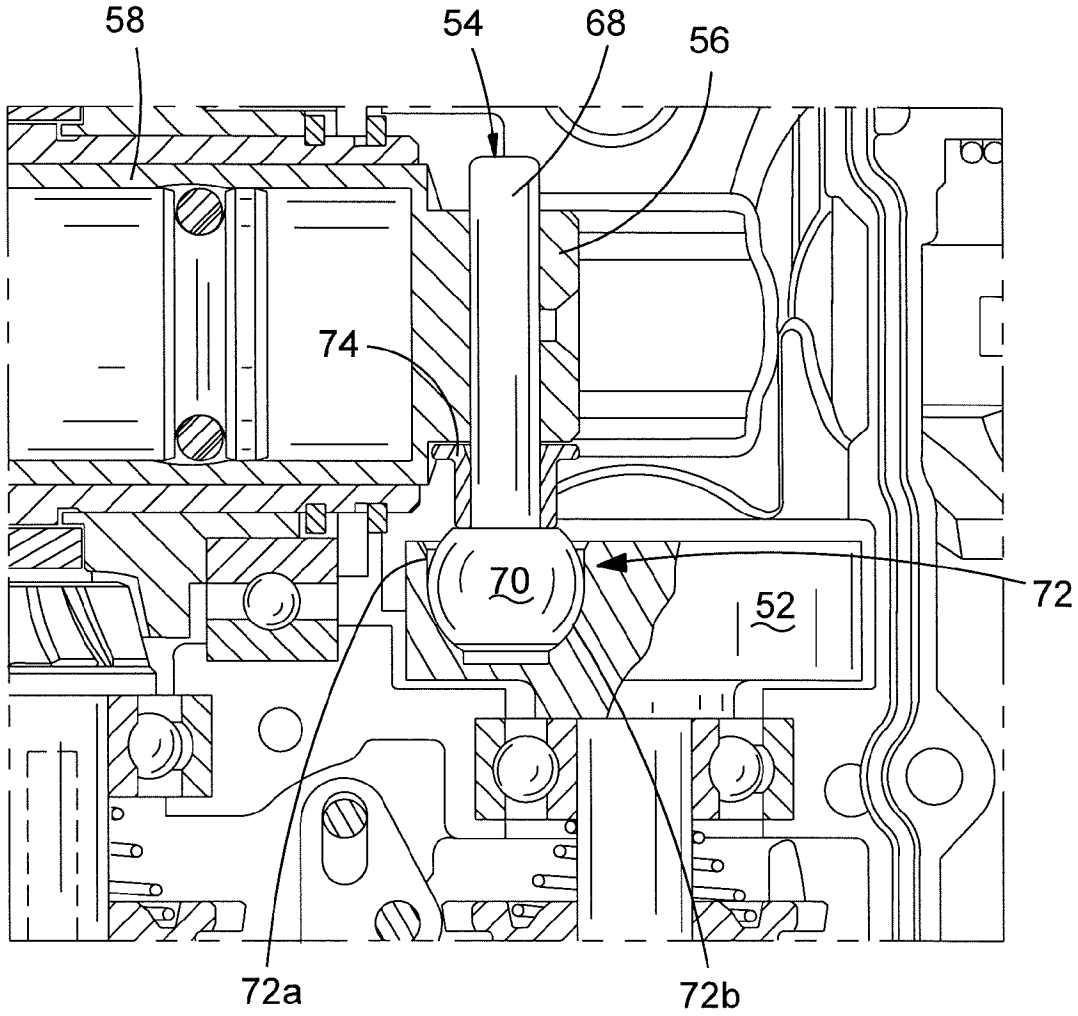
FIG. 3 is an enlarged side cross-sectional view of part of the hammer drill of FIG. 2.

Referring to FIG. 3, the hammer drive mechanism will be described in more detail. The crank pin 54 comprises a cylindrical link member 68 rigidly connected to a part-spherical bearing 70. The part-spherical bearing 70 is slidably and rotatably disposed in a cup-shaped recess 72 formed in the crank plate 52. The cup-shaped recess 72 has an upper cylindrical portion 72*a* and a lower generally semi-spherical portion 72*b*. The upper cylindrical portion 72*a* and a lower semi-spherical portion 72*b* have the same maximum diameter which is slightly greater than that of the part-spherical bearing 70. As a result, the part-spherical bearing 70 can be easily inserted into the cup-shaped recess. The crank pin 4 can pivot, rotate and slide vertically relative to the crank plate whilst the part-spherical bearing remains within the confines of the cup-shaped recess 72.

The cylindrical link member 68 is slidably disposed in a cylindrical bearing 56 formed in the end of the hollow piston 58. Sliding friction in the cup-shaped recess 72 is slightly greater than in the cylindrical bearing 56. The cylindrical link member 68 therefore slides up and down in the cylindrical bearing 56 while the part-spherical bearing rocks back and forth in the cup-shaped recess. A cylindrical collar member 74 surrounds the cylindrical link member 68 of the crank pin 54 and can slide between a lower position in which it abuts the upper surface of the part-spherical bearing 70 and an upper position in which it abuts and the underside of the cylindrical bearing 56. The collar member 74 is a precautionary feature that limits movement of the part-spherical bearing 70 towards the cylindrical bearing 56 so that it is impossible for the crank pin 54 and the part-spherical bearing 70 to move totally out of engagement with the cup-shaped recess 72. The cylindrical collar member 74 can be mounted to the crank pin 54 after construction of the crank plate 52 and crank pin 54 assembly.

Figure 4:
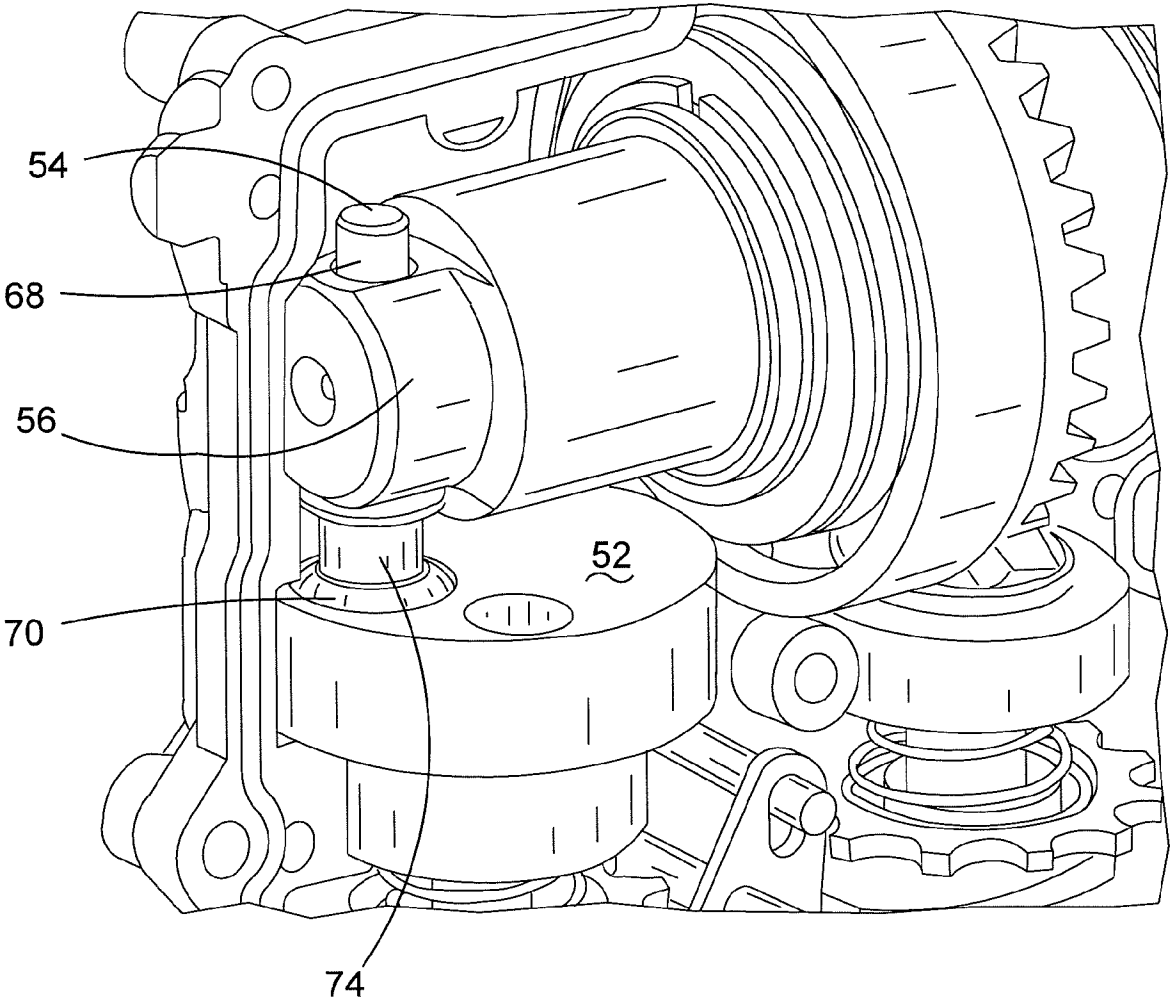
FIG. 4 is a partially cut away perspective view of part of the piston drive mechanism of FIG. 1 in its rearmost position.
Figure 5:
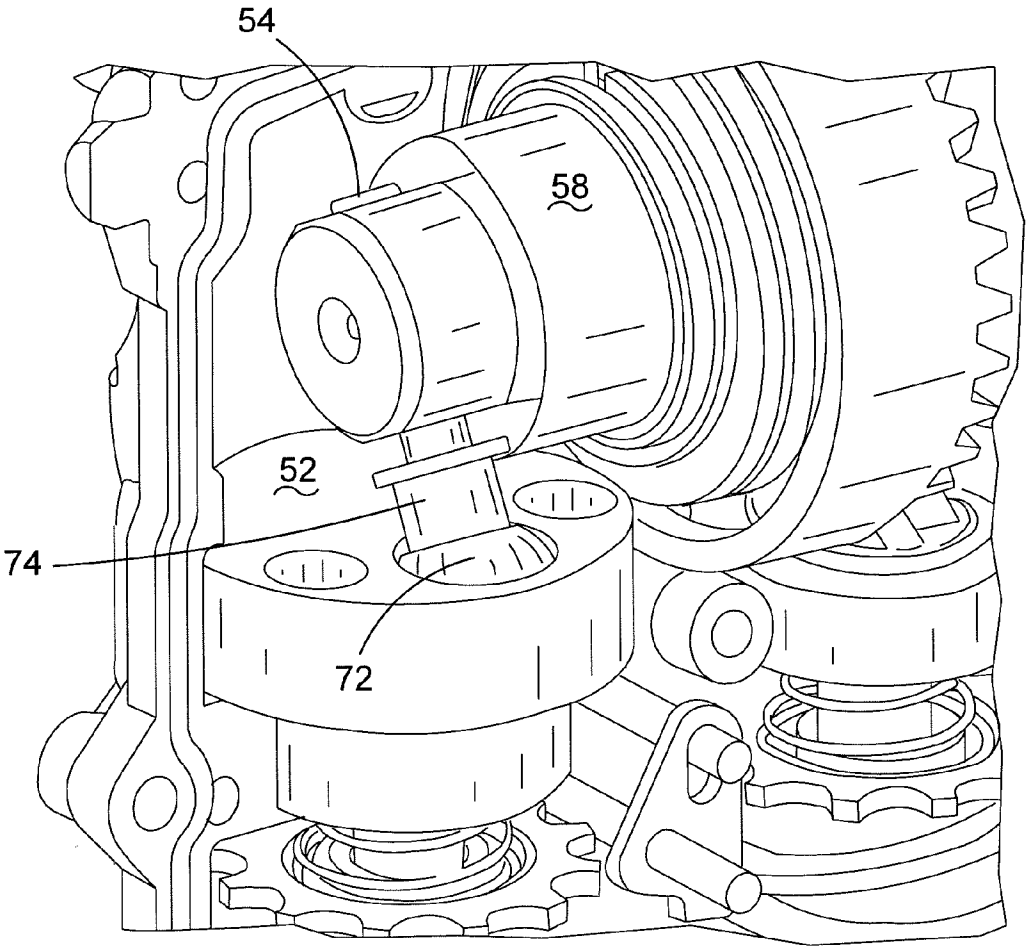
FIG. 5 is a partially cut away perspective view of part of the piston drive mechanism of FIG. 1 advanced through a quarter of a cycle of reciprocation from the position shown in FIG. 4.
Figure 6:
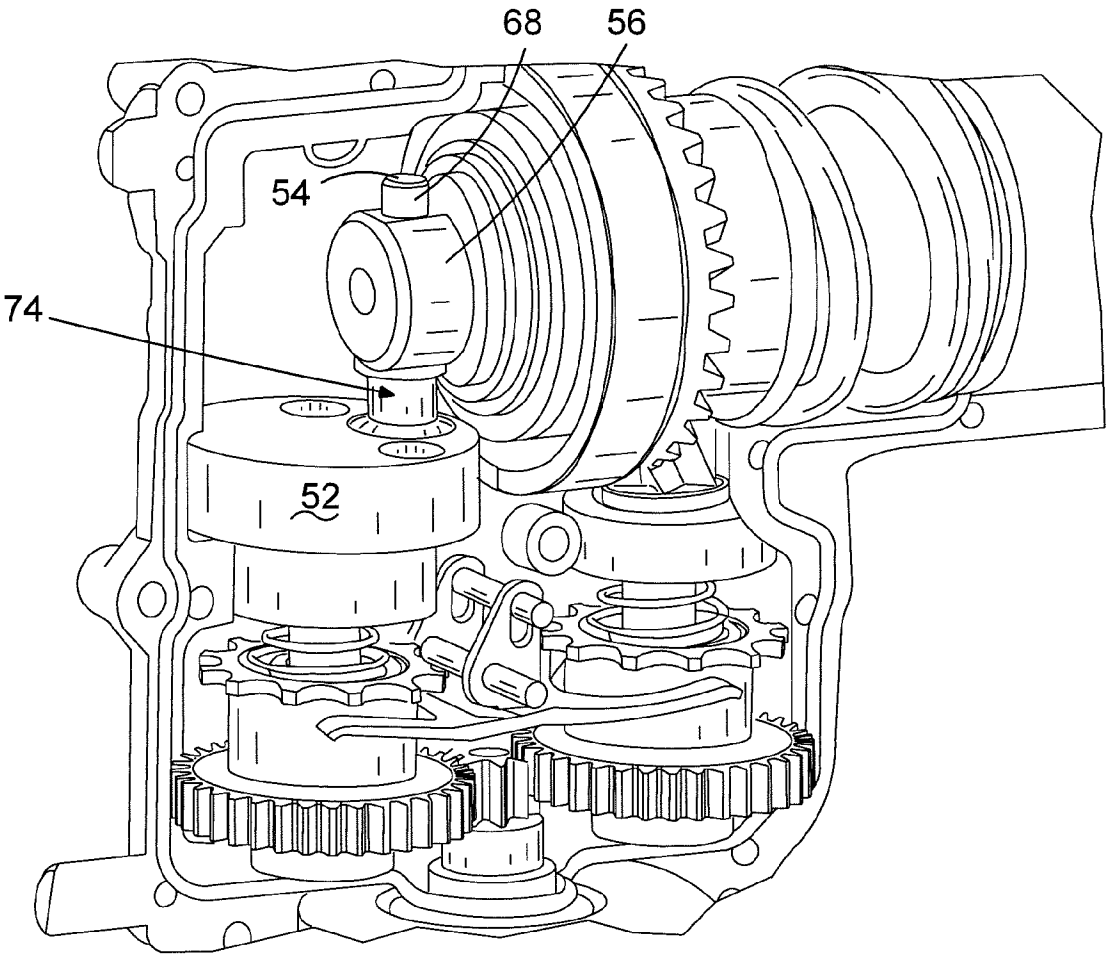
FIG. 6 is a partially cut away cross section of part of the piston drive mechanism of FIG. 1 advanced through half a cycle from the position shown in FIG. 4 to its foremost position.
Figure 7:
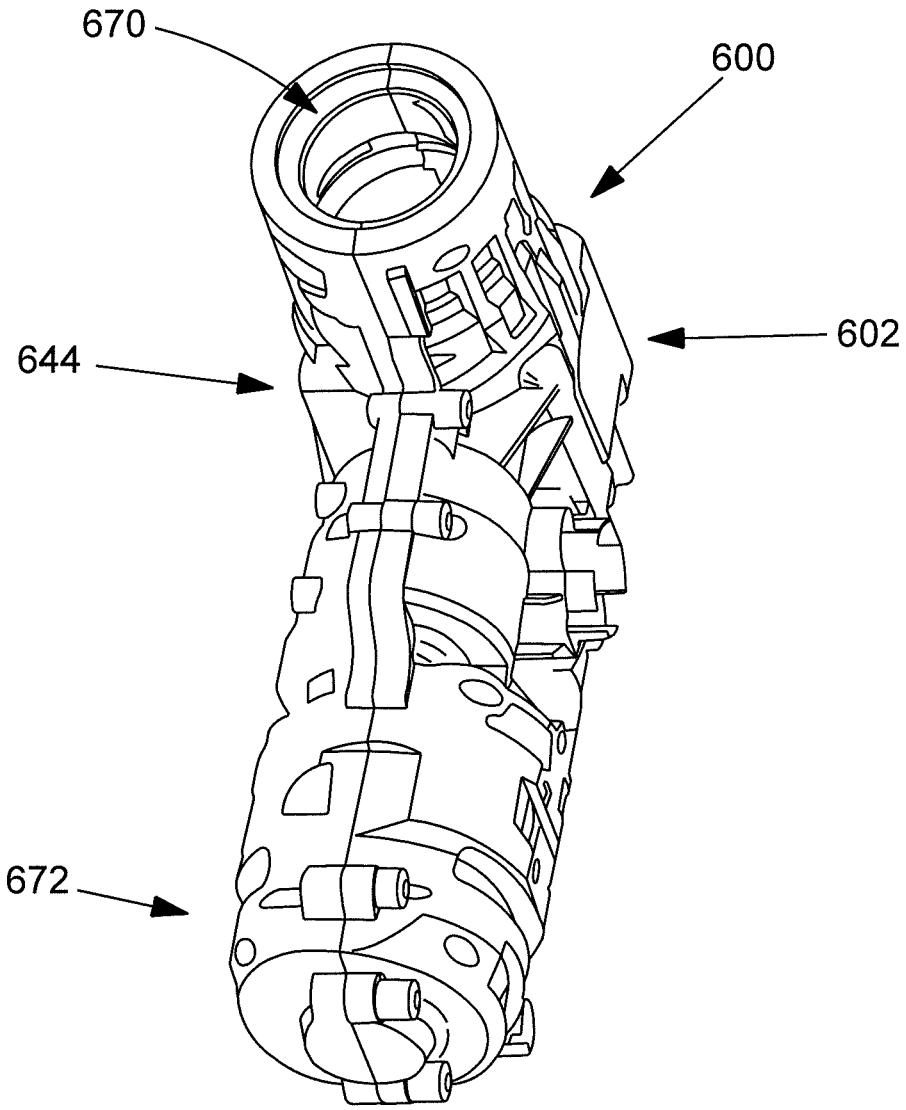
FIG. 7 shows the design of the assembled transmission housing in accordance with the embodiment of the present invention.

Referring to FIGS. 4 to 6, as the crank plate 52 rotates in the anti-clockwise direction from the upright position shown in FIG. 6, to the position shown in FIG. 7, it can be seen that the crank pin 54 pushes the hollow piston 58 forwardly and also tilts to one side. As the crank pin 54 tilts, the cylindrical link member 68 slides downwardly in the cylindrical bearing 56. As the crank plate 52 rotates from the position of FIG. 5 to the position of FIG. 6 to push the hollow piston 58 to its foremost position, the crank pin 54 re-adopts an upright position and the cylindrical link member 68 of the crank pin 54 slides upwardly inside cylindrical bearing 56. It can be seen that by engagement of the collar member 74 with the underside of the cylindrical bearing 56 and the top of the part-spherical bearing 70, the crank pin 54 is prevented from moving too far inside the cylindrical bearing and out of engagement with the crank plate 52. There is therefore no need for an interference fit to trap the crank pin into engagement with the crank plate, which significantly simplifies assembly of the drive mechanism.

An embodiment of the present invention will now be described with reference to FIGS. 7 to 13. The construction of the hammer drill is essentially the same as that disclosed in the above example except for the design of the transmission housing and the addition of an integral motor housing. Where the same features in the embodiment have previously been disclosed in the above example, the same reference numbers have been used. The same design of transmission mechanism, external housing handles, chuck and battery are used within the embodiment as in the example above.

FIG. 7 shows the new design of the assembled transmission housing 600. The transmission housing 600 is constructed from three component parts which are in the form of clam shells.

Figure 8:
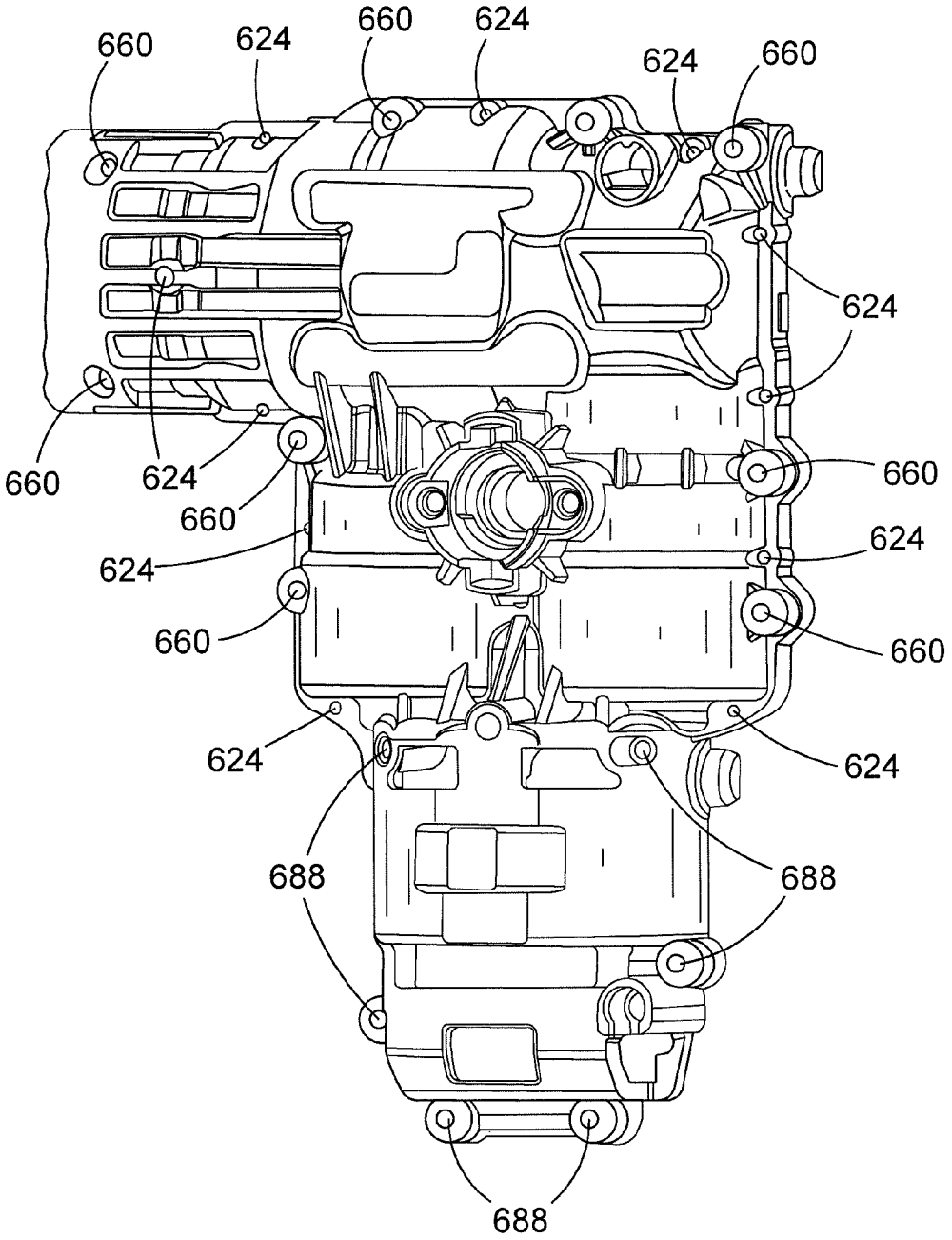
FIG. 8 shows the first part of the transmission housing of FIG. 7 with the integral motor housing from a first side.
Figure 9:
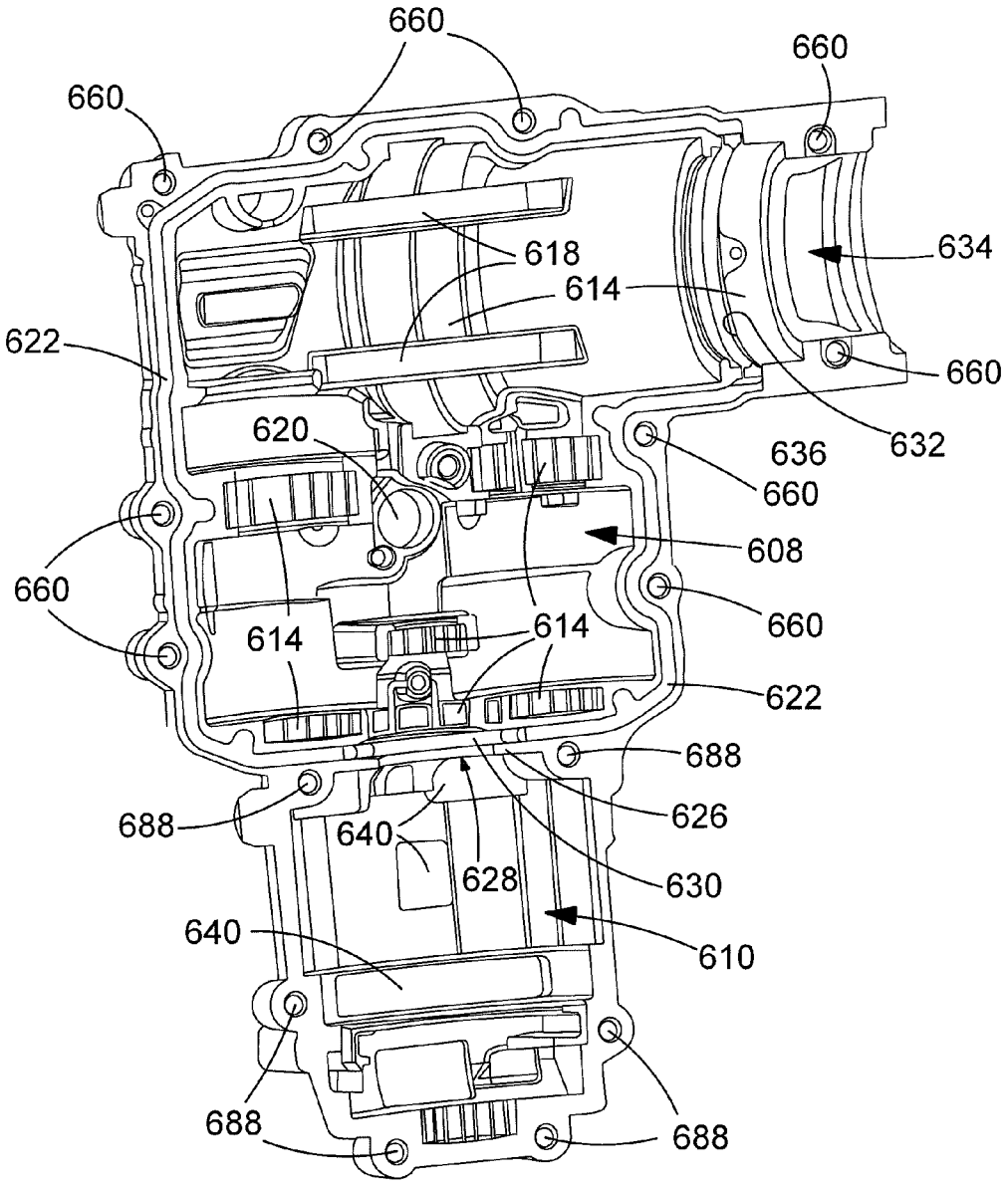
FIG. 9 shows the first part of the transmission housing of FIG. 7 with the integral motor housing from a second side opposite to that shown in FIG. 8.

The first part 602, which is formed in a one piece construction from durable plastic material, forms one half of the transmission housing 600 on one side and half of the housing for the motor 34 as seen in FIGS. 8 and 9. The first part 602 forms two recesses 608, 610, the first recess 608 for receiving part of the transmission mechanism, the second recess 610 for receiving the motor.

The inside of the first recess 608 is shaped to directly support one half of the transmission mechanism.

Formed inside of the first recess 608 within the wall of the recess 608 are semi-circular recesses 614 which receive and support one side of the support bearings 49, 604 (see FIG. 2) of the transmission mechanism. Elongate troughs 618 provide further support for one side of the transmission mechanism. An aperture 620 is form through the wall at the base of the recess 608 through which the shaft of the mode change knob can pass from the transmission mechanism to outside of the housing to be operated by a user.

A seal 622 is integrally moulded into a groove formed around the recess 608. Small apertures 624 are formed in a number of places in the base of the groove through which some of the seal 622 can pass during the moulding procedure to secure the seal 622 within the groove.

Formed within the wall 626 between the first 608 and second cavities 610 is a first semi-circular passageway 628. The groove is formed within the edge of the wall 626 around the semi-circular passageway 628 and the seal 622 is integrally moulded within this groove to form a semi-circular seal 630 around the edge of the wall 626.

Formed within the inner wall of the recess 608 is a semicircular groove 632 which runs around a tubular section 634 of the transmission housing. The seal 622 is integrally moulded within this groove 632 to form a second semi-circular seal 636 around the tubular section 634.

Similar, the inside of the second recess 610 is shaped so that it directly supports one half of the motor 34. Apertures 640 are formed through the side of the wall in the recess 610 so that an air flow can be drawn into the recess 610 and across the motor 34 by a fan and then is expelled from the recess 610, to cool the motor 34. A slot 642 is provided in which half of a brush card, for controlling the motor, can be inserted and held.

Figure 10:
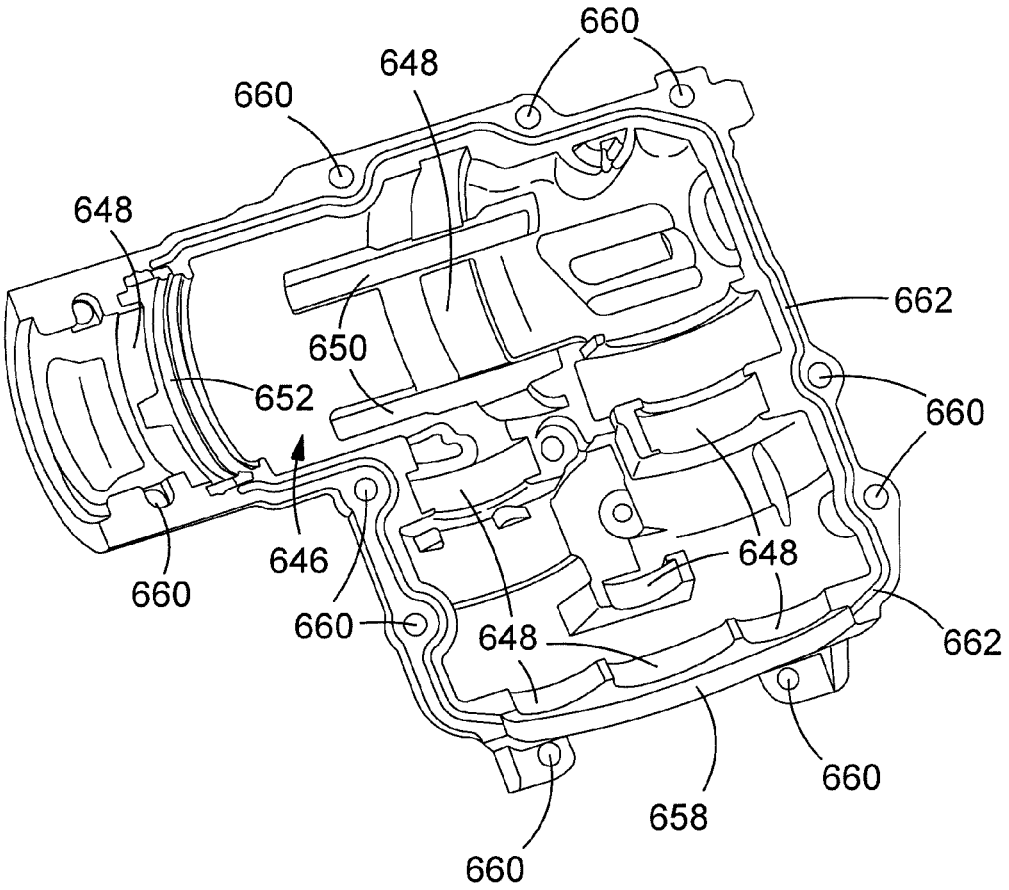
FIG. 10 shows the second part of the transmission housing of FIG. 7 from a first side.
Figure 11:
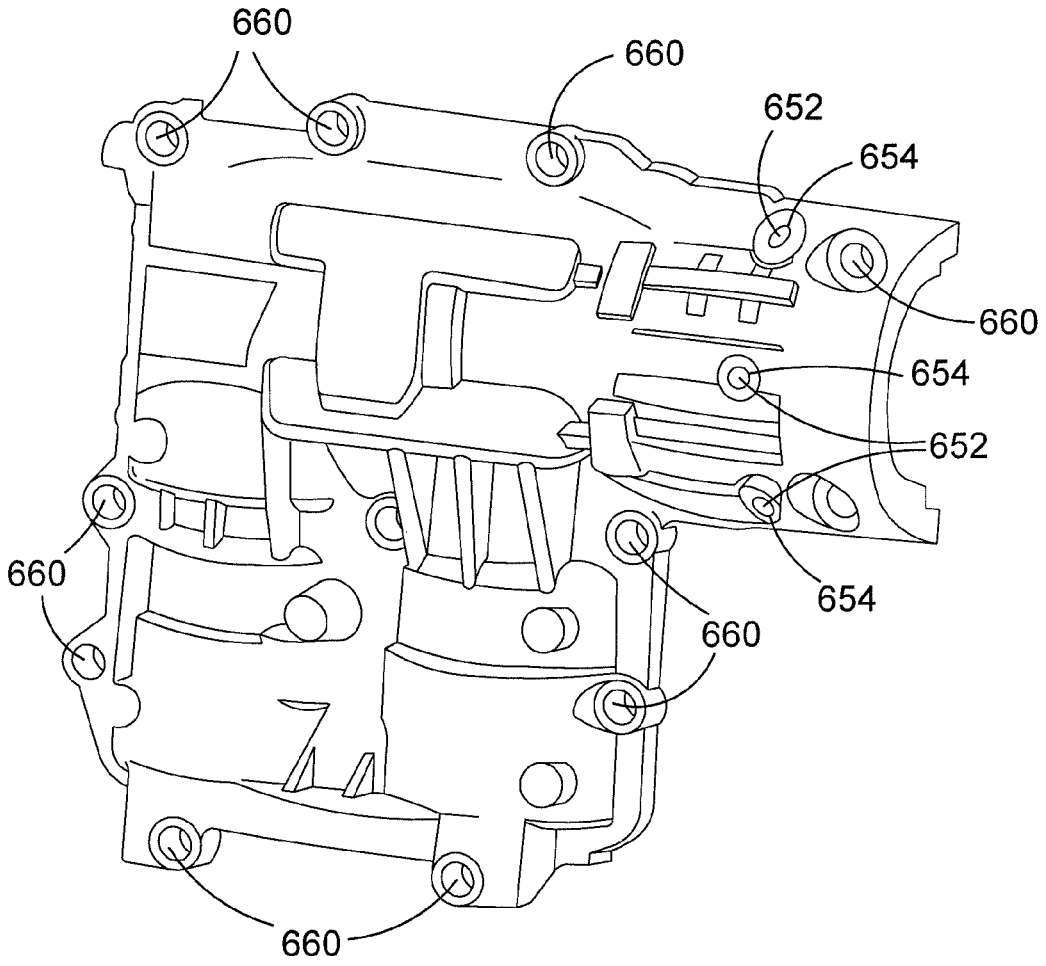
FIG. 11 shows the second part of the transmission housing of FIG. 7 from a second side opposite to that shown in FIG. 10.

The second part 644 of the transmission housing, which is formed in a one piece construction from cast aluminium, forms the second side of the transmission housing 600 only as seen in FIGS. 10 and 11. The second part 644 forms a recess 646 for receiving part of the transmission mechanism.

The inside of the recess 646 is shaped to directly support one half of the transmission mechanism.

Formed inside of the recess 646 within the wall of the recess 646 are semi-circular recesses 648 which receive and support the other side of the support bearings 49; 604 of the transmission mechanism. Whilst the second part 644 is cast to produce the overall part, the semi-circular recesses 648 are subsequently machined to ensure that their dimensions are matched perfectly with those of the bearings 49; 604 which are located within them. Elongate troughs 650 provide further additional support for the other side of the transmission mechanism.

A semi-circular seal 652 is moulded into a groove formed in one of the semi-circular recesses 648. Small apertures 654 are formed in a number of places in the base of the groove through which some of the seal 652 can pass during the moulding procedure to secure the seal 652 within the groove.

Formed within the wall 652 at the base of the recess is a semi-circular passageway 658.

The first part 602 is attached to the second part 644 by bolts which pass through apertures 646 in the first and second parts and are secured using nuts. When the two parts are secured to each other, the transmission mechanism is sandwiched between and supported by the two parts, half of each of the components of the transmission mechanism being supported in the first plastic part 602, the second half of each of the components of the transmission mechanism being supported in the second metal part 644.

A groove 662 is formed around the recess 646 in the second part 644 to receive the seal 622 of the first part which is aligned with the groove 662 when the first and second parts are attached to each other.

When the first and second parts are connected together, the second semi-circular seal 636 formed within the first part 602 aligns with the semi-circular seal 652 in the second part 644 to form a circular seal which located around a tubular section 634 within the housing. The seal 636, 652 surrounds and engages with the spindle 48 of the hammer drill which extends from the transmission mechanism in the transmission housing to outside of the hammer drill via an aperture 670, to prevent grease and oil within the transmission housing from leaking out of the transmission housing 600.

Figure 12:
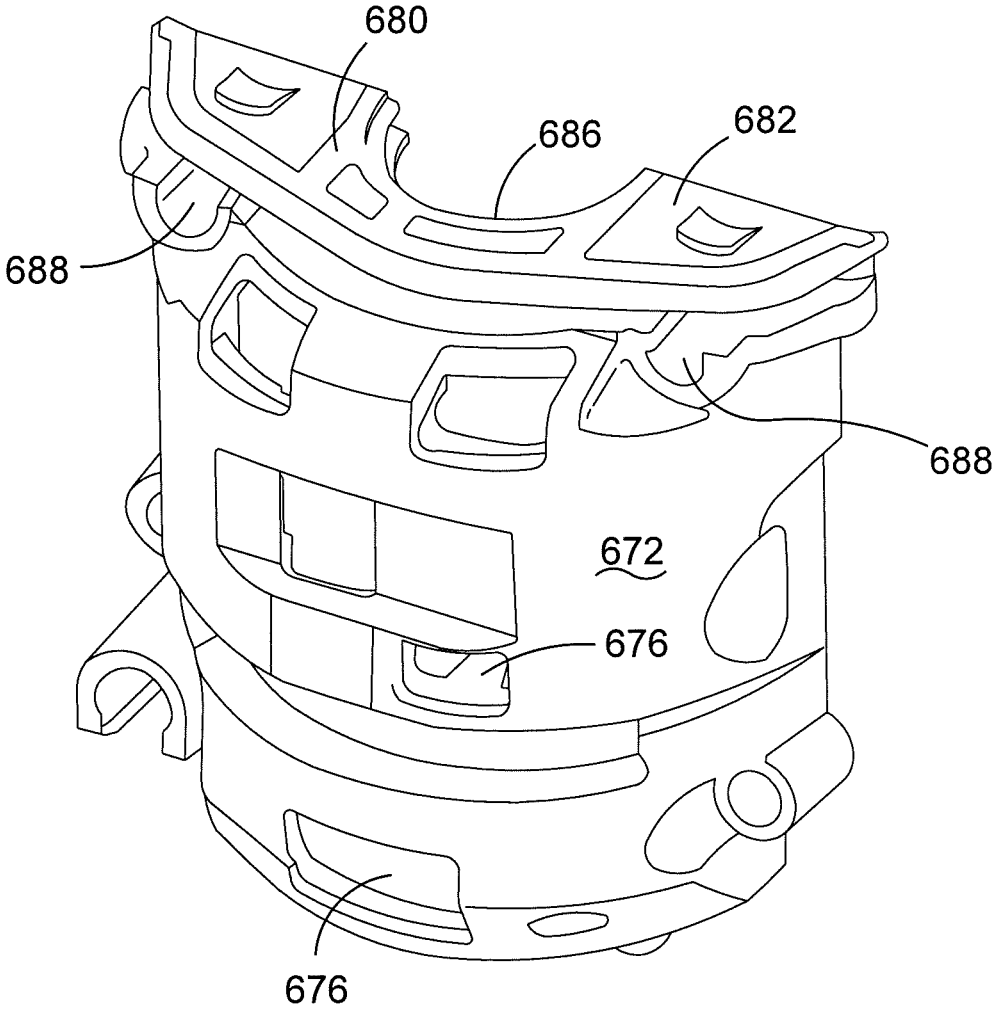
FIG. 12 shows the third part of the housing which form part of the motor housing of FIG. 7 from a first side.
Figure 13:
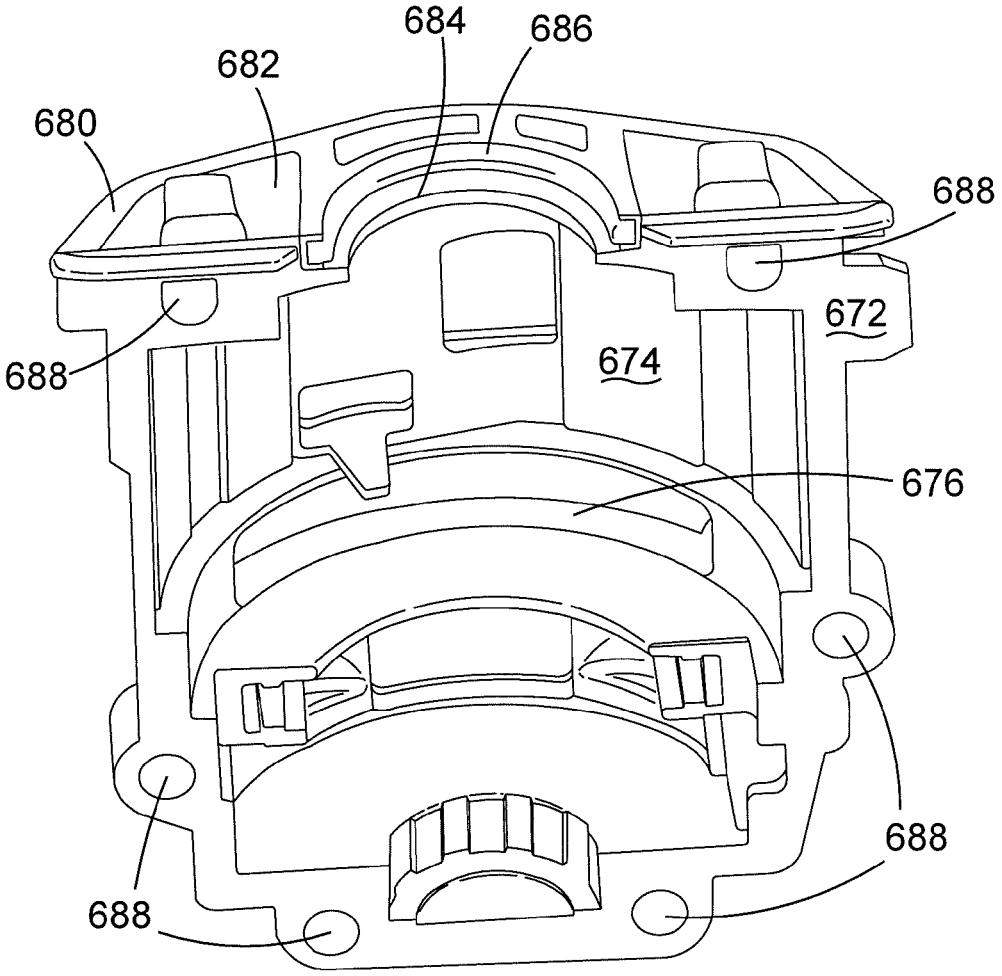
FIG. 13 shows the third part of the housing which forms part of the motor housing of FIG. 7 from a second side opposite to that shown in FIG. 12.

The third part 672, which is formed in a one piece construction from durable plastic material, forms the second half of the motor 606 for the motor 34 as seen in FIGS. 12 and 13. The third part 672 forms a recess 674 for receiving the motor 34.

The recess 674 is shaped so that it directly supports the second half of the motor 34. Apertures 676 are formed through the side of the wall in the recess 674 so that an air flow can be drawn into the recess 674 and across the motor 34 by a fan, and then expelled to cool the motor. A slot 678 is provided in which the second half of the brush card, for controlling the motor 34, can be inserted.

A seal 680 is integrally moulded into grooves formed within the top wall of the third part 672, outside of and facing away from the recess 674. Small apertures (not shown) are formed in a number of places in the base of the grooves through which some of the seal 680 can pass during the moulding procedure to secure the seal 680 within the grooves.

Formed within the top wall 682 is a semi-circular passageway 684. A groove is formed within the edge of the wall 682 around the semi-circular passageway 684 and the seal 680 is integrally moulded within this groove to form a semi-circular seal 686 around the edge of the wall 682.

The third part 672 is attached to the first part 602 prior the second part 644 has been attached. It is attached by using bolts which pass through the apertures 688 in the first and third parts and are secured using nuts. When the second part 644 is attached to the first part 602, the bottom section of the second part 644 sandwiches the top section of the third part 672, the two bolts which pass through the lower two apertures 646 of the second part 644 also passing through the top two apertures 688 of the third part 672 prior to passing through the apertures of the first part 602. When the two parts 602, 672 are secured to each other, the motor 34 and brush card are sandwiched between and supported by the two parts, half of each component being supported in the first plastic part 602, the other half of each component being supported in the third plastic part 672.

When the first and third parts are connected together, the first semi-circular seal 630 formed within the first part 602 aligns with the semi-circular seal 686 in the third part 672 to form a circular seal which locates around a circular aperture formed by the semi-circular passageway 628 in the first part 602 and the semi-circular passageway 684 in the second part 672, which are also aligned. The seal 630, 686 surrounds and engages with the shaft 36 of the motor 34 which passes from the motor 34 in the motor housing to the transmission mechanism in the transmission housing, to prevent grease and oil within the transmission housing from passing into the motor housing.

Furthermore, when the first, second and third parts are connected together, the seal 680 on the top wall 626 of the third part 672 engages with the outer surface of the lower wall of the second part 644 to provide a seal between the two.

It will be appreciated that the three parts could be designed so that, as an alternative, the third part 672 is attached to the first part 602 after the second part 644.

The invention claimed is:

1. A hammer drill comprising:

a body;

a motor mounted within the body;

a transmission housing mounted within the body, and a transmission mechanism mounted within the transmission housing configured to be rotatably driving and/or repetitively striking a cutting tool held by the hammer drill in response to rotation of an output shaft of the motor;

wherein the transmission housing comprises a first housing portion including a first recess, and a second housing portion including a second recess, the first and second housing portions being adapted to engage each other to support of the transmission mechanism within the transmission housing;

wherein the transmission housing further comprises a seal integrally moulded within a first groove formed around the first recess, a second groove is formed around the second recess, and the seal locates within the second groove in the second housing portion when the first and second housing portions are engaged with each other.

2. The hammer drill as claimed in claim 1, wherein the first housing portion comprises metal and the second housing portion comprises a plastic material.

3. A hammer drill comprising:

a body;

a motor mounted within the body; and a transmission housing mounted within the body, and a transmission mechanism mounted within the transmission housing configured to be rotatably driving and/or repetitively striking a cutting tool held by the hammer drill in response to rotation of an output shaft of the motor;

wherein the transmission housing comprises a first housing portion and a second housing portion adapted to engage each other to support of the transmission mechanism within the transmission housing;

wherein the transmission housing further comprises a semi-circular groove formed in the first housing portion; a first semi-circular seal moulded into the semi-circular groove; a semi-circular recess formed in the second housing portion; and a second semi-circular seal moulded into the semi-circular recess; and wherein the first semi-circular seal of the first housing portion aligns with the second semi-circular seal of the second housing portion when the first and second housing portions are engaged with each other to form a circular seal within the transmission housing.

4. A hammer drill as claimed in claim 3 wherein the first housing portion comprises a first portion recess;

wherein a first seal is integrally moulded within a first groove formed around the first portion recess;

wherein the second housing portion comprises a second portion recess;

wherein a second groove is formed around the second portion recess;

wherein the first seal locates within the second groove when the first and second housing portions are engaged with each other; and wherein the semi-circular seal in the first housing portion is integral with the first seal around the first portion recess.

5. The hammer drill as claimed in claim 3, wherein the first housing portion further extends to provide a housing portion for a motor housing.

6. The hammer drill as claimed in claim 5, further comprising a third housing portion which engages with the first housing portion to form a motor housing.

7. The hammer drill as claimed in claim 6, wherein the third housing portion comprises plastic material.

8. The hammer drill as claimed in claim 3, wherein the first housing portion comprises metal and the second housing portion comprises a plastic material.

9. A hammer drill comprising:

a body;

a motor mounted within the body; and a transmission mechanism mounted within the body and configured to be rotatably driving and/or repetitively striking a cutting tool held by the hammer drill in response to rotation of an output shaft of the motor;

a first housing portion, a second housing portion that engages the first housing portion to form a transmission housing to support the transmission mechanism; and a third housing portion that engages with the first housing portion to form a motor housing to support the motor;

wherein a semi-circular groove formed in an edge of a wall of the first housing portion;

a first semi-circular seal is moulded into the semi-circular groove;

a third portion groove is formed in an edge of a wall of the third housing portion;

a second semi-circular seal is moulded into the third portion groove; and the first semi-circular seal in the first housing portion aligns with the second semi-circular seal in the third housing portion when the first and third housing portions are engaged with each other to form a circular seal within the first and third housing portions.

10. The hammer drill as claimed in claim 9, wherein the first housing portion comprises a first recess;

wherein a seal is integrally moulded within a first groove formed around the first recess;

wherein the second housing portion comprises a second recess;

wherein a second groove is formed around the second recess;

wherein the seal locates within the second groove in the second housing portion when the first and second housing portions are engaged with each other; and wherein the first semi-circular seal in the first portion is integral with the seal surrounding the first recess.

11. The hammer drill as claimed in claim 9, wherein the first housing portion comprises metal and the second and third housing portions each comprises a plastic material.

12. A hammer drill comprising:

a body;

a motor mounted within the body; and a transmission mechanism mounted within the body and configured to be rotatably driving and/or repetitively striking a cutting tool held by the hammer drill in response to rotation of an output shaft of the motor;

a first housing portion, a second housing portion that engages the first housing portion to form a transmission housing to support the transmission mechanism; and a third housing portion that engages with the first housing portion to form a motor housing to support the motor;

wherein the third housing portion comprises grooves formed in an outer wall of the third housing portion, a seal is integrally moulded into the grooves, and when the first, second and third portions are engaged with each other, the seal engages with an outer surface of the second housing portion to form a seal between the second and third housing portions.

13. The hammer drill as claimed in claim 12, wherein a semi-circular groove is formed in an edge of a wall of the first housing portion;

wherein a first semi-circular seal is moulded into the semi-circular groove;

wherein a third portion groove is formed in an edge of a wall of the third housing portion;

wherein a second semi-circular seal is moulded into the third portion groove;

wherein the first semi-circular seal in the first housing portion aligns with the second semi-circular seal in the third housing portion when the first and third housing portions are engaged with each other to form a circular seal within the first and third housing portions; and wherein the second semi-circular seal in the third housing portion is integral with the seal moulded into the grooves of the third housing portion.

14. The hammer drill as claimed in claim 12, wherein the first housing portion comprises metal and the second and third housing portions each comprises a plastic material.

* * * * *